US010926272B2

(12) United States Patent
Wiesenberg et al.

(10) Patent No.: US 10,926,272 B2
(45) Date of Patent: Feb. 23, 2021

(54) ELECTROSTATIC PRECIPITATOR AND METHOD FOR ELECTROSTATIC PRECIPITATION OF MATERIALS OUT OF AN EXHAUST GAS FLOW

(71) Applicant: DAS Environmental Expert GmbH, Dresden (DE)

(72) Inventors: Ralph Wiesenberg, Dresden (DE); Stephan Trepte, Dresden (DE); Claas Loebbicke, Dresden (DE)

(73) Assignee: DAS Environmental Expert GmbH, Dresden (DE)

( * ) Notice: Subject to any disclaimer, the term of this patent is extended or adjusted under 35 U.S.C. 154(b) by 395 days.

(21) Appl. No.: 16/013,002

(22) Filed: Jun. 20, 2018

(65) Prior Publication Data

US 2019/0001346 A1 Jan. 3, 2019

(30) Foreign Application Priority Data

Jun. 30, 2017 (DE) ..... 10 2017 114 638.5

(51) Int. Cl.
*B03C 3/78* (2006.01)
*B03C 3/16* (2006.01)
*B03C 3/41* (2006.01)

(52) U.S. Cl.
CPC ..... *B03C 3/78* (2013.01); *B03C 3/16* (2013.01); *B03C 3/41* (2013.01); *B03C 2201/08* (2013.01); *B03C 2201/10* (2013.01)

(58) Field of Classification Search
CPC combination set(s) only.
See application file for complete search history.

(56) References Cited

U.S. PATENT DOCUMENTS 1,959,752 A * 5/1934 Wintermute ..... B03C 3/78 96/49
2,245,516 A * 6/1941 Wintermute ..... B03C 3/16 96/46
2,658,582 A * 11/1953 Wintermute ..... B03C 3/78 96/46
2,667,341 A * 1/1954 Busfield ..... B03C 3/78 261/115

(Continued)

FOREIGN PATENT DOCUMENTS

CN 2377006 Y 5/2000
CN 1333089 A 1/2002

(Continued)

*Primary Examiner* — Christopher P Jones
*Assistant Examiner* — Sonji Turner
(74) *Attorney, Agent, or Firm* — Rogowski Law LLC

(57) ABSTRACT

An electrostatic precipitator (1) to precipitate one or more materials (9) out of an exhaust gas flow (5) has a spray electrode (2) having an active part (14) for generating a corona discharge (6) and a flushing liquid supply (21), by means of which flushing liquid (10) is supplied into the precipitator (1) for removing deposits (11), made of the material(s) (9) to be separated, that settle on the spray electrode (2). The precipitator (1) uses less cleaning liquid and the cleaning is carried out more reliably. For this purpose, a flushing device (8) directs the flushing liquid (10) across a head region (12) of the spray electrode (2) onto the active part (14) of the spray electrode (2) as a flushing stream (22).

19 Claims, 12 Drawing Sheets

(56) References Cited

U.S. PATENT DOCUMENTS 2,874,802 A * 2/1959 Gustafsson ..... C25B 11/00 95/71
3,331,192 A * 7/1967 Peterson ..... B03C 3/16 96/27
3,551,674 A * 12/1970 Ove ..... B03C 3/53 250/361 R
3,765,154 A * 10/1973 Hardt ..... B03C 3/53 96/88
4,541,844 A * 9/1985 Malcolm ..... B01D 47/00 95/64
4,619,670 A * 10/1986 Malcolm ..... B01D 47/00 422/168
4,662,902 A * 5/1987 Meyer-Pittroff ..... C02F 1/16 261/160
5,066,316 A * 11/1991 Ikeda ..... B03C 3/53 96/52
5,254,155 A * 10/1993 Mensi ..... B03C 3/16 96/100
6,110,256 A * 8/2000 Reynolds ..... B03C 3/019 95/4
6,193,782 B1 * 2/2001 Ray ..... B03C 3/16 55/DIG. 38
6,294,003 B1 * 9/2001 Ray ..... B03C 3/16 55/DIG. 38
6,365,112 B1 * 4/2002 Babko-Malyi ..... B01D 53/323 204/164
6,488,740 B1 * 12/2002 Patel ..... B03C 3/16 95/71
6,632,267 B1 * 10/2003 Ilmasti ..... B03C 3/78 95/59
7,115,153 B2 10/2006 Ahlborn et al.
7,297,182 B2 * 11/2007 Ray ..... B01D 47/06 95/58
7,318,857 B2 * 1/2008 Ray ..... B01D 47/06 96/44
8,088,198 B2 * 1/2012 Bengtsson ..... B03C 3/16 95/71
2008/0257157 A1 * 10/2008 Huang ..... F23J 15/04 96/53
2018/0071751 A1 * 3/2018 Voronin ..... B03C 3/36

FOREIGN PATENT DOCUMENTS

CN 201815214 U 5/2011
CN 204134742 U 2/2015
CN 206064625 U 4/2017
DE 1093447 A1 11/1960
DE 138608 11/1979
DE 20211439 U1 12/2003
EP 0014497 A1 8/1980
GB 387205 A * 2/1933 ..... B03C 3/78
JP 2013240741 A 12/2013
KR 20130067576 A 6/2013

* cited by examiner

ELECTROSTATIC PRECIPITATOR AND METHOD FOR ELECTROSTATIC PRECIPITATION OF MATERIALS OUT OF AN EXHAUST GAS FLOW

CROSS-REFERENCE TO RELATED APPLICATIONS

This application claims benefit under 35 USC 119(a) of German application No. 10 2017 114 638.5, filed Jun. 30, 2017, the contents of each of which are incorporated by reference herein.

BACKGROUND OF THE INVENTION

Technical Field and State of the Art

The invention relates to an electrostatic precipitator and a method for electrostatic precipitation of materials out of an exhaust gas flow.

Various technologies are used in systems for exhaust gas purification and also for waste air purification. Thus, it is possible to combust, scrub, or free the smallest particles from exhaust gases. To purify exhaust gases arising from the manufacturing of semiconductor products, for example, silicon-based solar modules or LEDs, these types of systems are usually operated in continuous operation, thus 24 hours per day and seven days per week. However, devices are also comprised by the inventions that are used for treating an exhaust gas flow, for example, a process gas flow. Such an exhaust gas flow may also be further used within a process chain after treatment in a precipitator.

Electrostatic precipitators, in particular tubular electrostatic precipitators comprising a wall over which an aqueous separating liquid washes, have been proven as compact and low-maintenance technologies for precipitating materials, in particular particles out of gas flows, wherein gas flows of this type may also contain corrosive gas residues. The materials to be separated, in particular the particles to be separated, are thereby electrically charged by a high-voltage field and drawn into the liquid film formed by the separating liquid, which is at ground potential. At least one high-voltage electrode is provided in the precipitator for generating a corona discharge in the exhaust gas flow in order to effect the electric charging of the materials to be separated. The high-voltage electrode is therefore also designated as a spray electrode.

By applying a high voltage to the spray electrode, the corona discharge is generated between an active part of the spray electrode and the liquid film acting as a counter electrode. The spray electrode may be particularly designed for a targeted and uniform formation of the corona discharge along the active part. For example, the spray electrode may have at least one discharge tip, starting from which the corona discharge is generated. An example for this type of electrostatic precipitator is known from JP 2013-240741 A.

During the precipitation operation, a part of the materials to be separated does not, however, arrive at the liquid film made from separating liquid which is provided for that purpose, but instead deposits on other parts of the precipitator, in particular on the spray electrode. The generation of the corona discharge is hampered by the materials deposited there. If the materials to be separated may no longer be sufficiently strongly electrically charged due to the limited corona discharge, then the precipitation output of the precipitator diminishes over time. This may primarily lead to materials that are to be separated actually remaining in the exhaust gas flow and passing through the precipitator. In this way, these materials arrive at the downstream processes or are released into the environment.

A passing through of non-precipitated materials leads to a secondary disadvantage, such that the materials or particles settle in areas of the precipitator downstream of the precipitation region. The atmosphere in the outflow of the precipitator is saturated with water vapor due to passage across the separating liquid, whereby electrically-conductive film-like coatings may form due to the condensation. Electric leakage currents occur along the surfaces, influenced by the high voltage applied to the spray electrode. In extreme cases, the leakage currents may form along the surfaces between the spray electrode, to which high voltage is applied, and the ground potential. Electric high-voltage breakdowns may even thereby occur.

To prevent these disadvantageous primary and secondary effects, the spray electrode guiding the high voltage must be regularly freed from deposits in order to guarantee a sufficient precipitation output of the electrostatic precipitator at all times.

A tubular electrostatic precipitator is known from KR 10-2013-0067576 A, which has multiple spray nozzles in the interior, with which the interior of the precipitator may be cleaned. The cleaning liquid introduced by the spray nozzles thereby covers not only the high-voltage electrodes but also the entire interior space of the precipitator. A large amount of the cleaning liquid is thereby used to flush deposits from the electrodes. In addition, fine and very fine droplets are generated by the spray nozzles, which are carried farther by the gas flow that is restored after the cleaning, and which may lead to leakage currents and breakdowns in downstream areas.

To prevent leakage currents and high-voltage flashovers, an implementation for an electrode is disclosed in JP 2013-240741 A, in which a specific design of an insulator should prevent flashovers. However, the previously described solutions do not offer a long-term solution.

An electric precipitator is known from DE 202 11 439 U1 for removing oil from an air flow of a crankcase ventilation system of an internal combustion engine. The precipitator has a spray electrode and a precipitation electrode. An injection device injects a cleaning liquid into the precipitator onto at least one of the two electrodes.

An ionizing electrode with ionizing tips for use in electrofilters is known from EP 0 014 497 A1, in which exhaust gases containing liquid components are cleaned. In the working position of the ionizing electrode, each component of the ionizing tip is arranged lower than the point of the ionizing tip with the highest charge concentration. Thus, deposit formation at these points and thus the inactivation of the ionizing points is substantially reduced.

A device for preventing the formation of condensation and/or dust deposit formation in support insulators of electric dust precipitators is known from DD 138 608 A1. In an insulator interior space, planar throttle elements, which are provided underneath the insulator cover outfitted with cleaning openings and covered with a plate, throttle the purge gas flowing in through the openings in the insulator cover in such a way, and distribute it across the open cross section of the insulator interior space, so that a uniform displacement flow is generated.

A device for preventing turbulence leading to contamination during the ventilation of insulators in electric gas cleaning systems, or emulsion separation systems, is known from DE 10 93 447 A. The insulator is enclosed by a flush tube or diffuser tube, which protects it against contamination, a cleaning gas or other cleaning means is guided through said tube flowing around the insulator. The flush tube or diffuser tube thereby has a Venturi tube shape.

An underlying object of the present invention is to specify an improved electrostatic precipitator and an improved method for electrostatic precipitation of materials out of an exhaust gas flow, in which the use of cleaning liquid is reduced with respect to the prior art and the cleaning is carried out more reliably.

SUMMARY OF THE INVENTION

In the context of the invention, materials to be separated are understood in particular to be solid or liquid particles with an aerodynamic diameter in a size range of less than 10 μm. Optionally, other particle types or materials present in the exhaust gas flow that are not in the form of particles, but instead as gas, may also be included.

According to one embodiment of the invention, an electrostatic precipitator is provided for precipitating one or more of the specified materials out of an exhaust gas flow which is guided through the electrostatic precipitator. The electrostatic precipitator has a spray electrode with an active part for generating a corona discharge and a flushing liquid supply, by means of which flushing liquid may be supplied into the precipitator for cleaning the spray electrode. The cleaning functions in order to partially or completely remove deposits or the material(s) to be separated that are present on the spray electrode. The invention is characterized in that the electrostatic precipitator has a flushing device, which is designed to direct the flushing liquid across a head region of the spray electrode as a flushing stream, so that the active part of the spray electrode is flushed by the flushing stream. The flushing stream generated during the so-called regeneration mode of the precipitator thereby carries away deposits that are located on the active part. Due to this embodiment of the electrostatic precipitator, the amount of flushing liquid required for cleaning the spray electrode may be significantly reduced with respect to devices from the prior art. Due to the lower amount of flushing liquid required, the flushing time required for flushing the electrode may likewise be reduced for a comparably sized flushing liquid supply. By this means, the duration of the regeneration mode is reduced as a whole, and the precipitator may be operated relatively longer in the precipitation mode so that the effective precipitation output of the electrostatic precipitator is further increased. Because the deposits and conductive condensation occur in significantly smaller quantities in the outflow region of the precipitator, a manual cleaning of these areas is required less often.

It may be provided according to the invention that the flushing device has means for reducing the flow speed of the flushing stream with respect to the flow speed of the influx of flushing liquid delivered by the flushing liquid supply. The reduction of the flow speed thereby also, if applicable primarily, takes place through a cross-sectional widening. A type of flow resistance may also be provided within the flushing device, by means of which the flushing liquid entering into the flushing device is reduced in its flow speed. A part of the flushing liquid is thereby buffered in the flushing device so that during the flushing process, less flushing liquid leaves the flushing device as a flushing stream than enters into the flushing device as flushing liquid via the influx. The introduction of flushing liquid into the flushing device is carried out over a shorter period of time than the actual flushing process by the flushing stream. By this means, drops introduced into the precipitator by the influx of flushing liquid may potentially settle in a timely way, before the exhaust gas flow and the additional precipitation process start again.

According to the invention, the flushing device has a cup element, whose bottom faces the active part and whose opening faces the head region of the spray electrode. This type of embodiment of the flushing device is particularly easy to manufacture and to assemble.

Furthermore, it is provided according to the invention, that the bottom of the cup element and/or its peripheral wall has at least one flushing opening, for example, holes, slots, and/or the like for dispensing the flushing stream. The flushing stream thereby emerges through the flushing openings out of the flushing device and spills out onto the provided areas of the spray electrode. It may thereby be provided that flushing liquid introduced into the cup element runs out over flushing openings provided in the bottom of the cup element.

It is further provided according to the invention that the at least one flow resistance, for example, a deflection device, is provided within the cup element to increase the flow resistance for the flushing liquid and/or to generate and/or reinforce a turbulent current in the flushing liquid. This advantageously affects the uniform distribution and the controlled draining of the flushing liquid on the spray electrode. This is particularly the case if the influx of flushing liquid is carried out laterally into the flushing device. For example, a disk or ring-shaped insert may be provided as a deflection device, which is arranged within the cup element. The flushing liquid entering into the cup element is then swirled, its flow speed decreases and it discharges from the flushing device in a controlled way as a flushing stream.

According to one preferred embodiment of the invention, it may be provided that at least one projecting discharge point is provided in the active part of the spray electrode in order to generate the corona discharge. The flushing device is thereby designed with devices for guiding the flushing stream across the at least one discharge point. The flushing stream is guided in a more targeted way to the relevant areas, which are the regions in which the corona discharge is generated, to achieve a high precipitation output. The required amount of flushing liquid is thus better exploited, by which means the cleaning of the spray electrode is more efficient.

Furthermore, it may be provided that the spray electrode has at least two, preferably multiple discharge points in its longitudinal direction. The flushing device is designed in such a way that the flushing stream successively flushes the at least two discharge points that are arranged in the longitudinal direction of the spray electrode. In this way, the required amount of flushing liquid may be reduced, since the flushing stream is used for flushing at least two discharge points, and thus a greater proportion of the flushing liquid is available for cleaning a single discharge point.

In a refinement of the invention, it may additionally be provided that the spray electrode is fastened at its head region and the active part extending in its longitudinal direction is arranged suspended in the interior of the precipitator, wherein the flushing stream runs on the active part assisted by gravity. In this way, an undesired ingress of flushing liquid in the fastening region of the spray electrode may be prevented or at least significantly reduced. Due to the gravity-assisted running of the flushing liquid along the spray electrode, the undesired formation of fine or very fine drops of flushing liquid within the precipitator may be avoided or at least significantly reduced so that drops of this type are only discharged from the precipitator in negligible amounts upon restoring the exhaust gas flow.

The spray electrode may additionally be formed in sections using a plate element or rib element and with a discharge point provided thereon. It has been demonstrated that a particularly uniform generation of the corona discharge is possible due to this type of embodiment. At the same time, these types of spray electrodes are easily and inexpensively manufacturable. For example, two or more plate segments may be laterally stamped forming the discharge points that are subsequently joined to one another to form the spray electrode. In the longitudinal direction, the spray electrode may thereby have a star-shape, cross-shape, or have multiple arms in cross section, which is formed by the individual plates or rib elements.

According to one preferred embodiment of the invention, it may be provided that the flushing device is designed as approximately concentric to the cross section of the spray electrode for a uniform distribution of the flushing liquid on the spray electrode. In this way, the flushing liquid may be guided particularly advantageously onto the spray electrode so that a uniformly distributed flushing stream forms across the cross section of the spray electrode.

It may thereby be preferably provided that at least one flushing opening is aligned with the at least one discharge point of the spray electrode. The flushing openings may thereby be aligned, for example, with the arrangement of the discharge points of the spray electrode, for example, are situated in register with the discharge points.

Alternatively or additionally, flushing openings may be provided in the peripheral wall of the cup element so that, upon reaching a specific liquid level within the flushing device, the flushing stream, or an additional flushing stream, pours out of the peripheral wall of the cup element. The flushing openings in the peripheral wall may likewise be aligned with the arrangement of the discharge points of the spray electrode so that the flushing stream or parts of the flushing stream may be poured in a targeted way on the areas of the spray electrode to be cleaned. According to the type and embodiment of the spray electrode, alternatively depending on the respective production method, the flushing openings may be designed as holes, slots, or the like.

It is also conceivable, for example, that the flushing openings designed as slots include at least a small part of the active part of the spray electrode or are placed thereon and thus are aligned with the discharge points.

In addition, according to the invention it may be the case that the head region of the spray electrode has an electrical connection for connecting the spray electrode to an electrical supply outside of the precipitation chamber of the precipitator, wherein the electrical connection and the precipitation chamber are separated from one another by means of an electrode collar functioning as a moisture barrier. In this way, leakage currents and electrical breakdowns may be effectively prevented.

The electrode collar acting as a moisture barrier may thereby have a wet side and a dry side, wherein the dry side is arranged outside of the precipitation chamber and the wet side is arranged inside of the precipitation chamber. The electrode collar for the spray electrode has a chamber, to which a dry purging gas is applied from outside, and through which a part of the spray electrode extends.

Due to the chamber, to which a dry purging gas is applied from outside, the occurrence of leakage currents out of the precipitation chamber to the electrical connection may be prevented particularly well, because the dry purging gas actively displaces and dries any liquid or moisture penetrating into the chamber from the precipitation chamber. The chamber is thereby operated at a slight overpressure, wherein dry purging gas continuously emerges from the chamber of the electrode collar into the precipitation chamber and thereby drives back any liquid or material penetrating into the precipitation chamber. The purging gas may, for example, be gas considered to be inert in the prevailing processing environment (for example, dried air, nitrogen, or $CO_2$) with a low humidity, preferably a dew point of less than 0° C. Compressed air may be particularly preferably used here, which is often easily and inexpensively available in the processing environment.

It may be additionally preferably provided that the electrode collar for the spray electrode has a purging gap for the purging gas on the wet side, through which the purging gas escaped into the precipitation chamber. The electrode collar may have a widening, through which a purging gap for the purging gas remains clear on the wet side between the spray electrode and the electrode collar. The purging gas flow is set such that the exit speed through the purging gap is higher than the flow speed of the exhaust gas flow in the precipitator column; the exit speed of the purging flow preferably lies between one and two times the flow speed of the exhaust gas flow to be purified. The purging gap may preferably be designed as an annular gap or as a gap adjusted to the cross-sectional shape of the spray electrode. The purging gap is preferably designed as annular shaped between the electrode collar and the spray electrode and extends between the chamber in the electrode collar and the precipitation chamber.

It has proven particularly advantageous to divide the chamber for the purging gas provided in the electrode collar into a central chamber and an outer annular chamber connected to a purging gas supply, wherein the central chamber and the annular chamber are separated from one another by means of a homogenization device for the purging gas flow, in particular an annular sponge. The purging gas flow, which exits through the chamber out of the purging gap into the precipitation chamber, may be homogenized particularly well in this way. A supply of the purging gas may thus be carried out at any side of the outer annular chamber. The homogenization device provided between the outer annular chamber and the central chamber causes a uniform purging gas flow moving inward. The homogenization device may simultaneously also act as an air filter, which prevents the entry of undesired materials into the central chamber and thus in the direction of the purging gap and the precipitation chamber.

The present invention may additionally be configured such that the flushing liquid supply is designed in such a way, for example like a tube, so that the influx of flushing liquid enters at least partially as a solid stream into the flushing device. In this way, the piping expense within the precipitation chamber may be significantly reduced. Simultaneously, a physical connection of the flushing liquid supply with the flushing device and thus indirectly with the spray electrode is eliminated, by which means the insulating properties of the precipitator are improved. Due to the omission of separate pipes or tubes in the interior of the precipitator for transferring the flushing liquid into the flushing device, the unused surface present in the precipitation chamber, on which undesired deposits and conductive films might potentially form, is also reduced.

Alternatively to the previously described embodiment of the flushing liquid supply, it may be provided that the electrodes collar, in particular its central chamber, has the flushing liquid supply. In this case, a separate supply inside of the precipitation chamber is omitted. At the same time, the flushing liquid may be applied to the spray electrode in a particularly targeted way. The flushing liquid thereby then enters through the purging gap and across the head region of the spray electrode into the flushing device. In addition to the omission of the separate connection for the flushing liquid supply at the precipitation chamber, this embodiment ensures a particularly compact structure of the device.

Another aspect of the invention is a method for the electrostatic precipitation of materials out of an exhaust gas flow. In particular, such a method may be carried out using a previously-described electrostatic precipitator. The electrostatic precipitator is thereby operated alternating between a precipitation mode and a regeneration mode, wherein the exhaust gas flow is guided through a corona discharge generated in the precipitator during the precipitation mode. The corona discharge is generated between the active part of the at least one spray electrode and a counter electrode. The counter electrode is thereby preferably formed by a grounded fluid wall, which is made from separating liquid and lies opposite the spray electrode. During the regeneration mode, the exhaust gas flow and the corona discharge are interrupted in order to at least partially remove deposits, made of the material(s) to be separated, from the spray electrode with a flushing liquid.

One method according to the invention is characterized in that the flushing liquid from a flushing device is directed via the head region of the spray electrode, as a flushing stream on the active part of the spray electrode, so that the flushing stream runs along the spray electrode under the influence of gravity, and thereby it at least partially flushes away deposits of the material(s) on the spray electrode. As already previously described, the required amount of flushing liquid may be reduced over the prior art and also the time required for the cleaning.

It may be preferably provided that an influx of flushing liquid is initially guided to the head region of the spray electrode and, by means of the flushing device, from there over the active part of the spray electrode as a flushing stream. Due to this two-part design, the supply of the flushing liquid may be carried out to a certain extend independently from the actual flushing process, in particular, more quickly, by which means the operation of the electrostatic precipitator is simplified over all.

In addition, a method according to the invention allows a settling of fine drops, which may be generated during the supply of the flushing liquid, before the precipitation mode is started again. An exporting of these drops due to the restarting of the exhaust gas flow into the outflow region of the precipitator may thus be significantly reduced.

One advantageous method according to the invention may be characterized particularly preferably in that the flushing device swirls the flushing liquid during the generation of the flushing stream and/or distributes the flushing liquid across a cross section of the spray electrode. In this way, the cleaning of the spray electrode may be carried out particularly efficiently and uniformly, regardless of the direction from which and the speed with which the influx of flushing liquid enters into the flushing device.

The electrostatic precipitators according to the invention may be fluid-mechanically coupled to other electrostatic precipitators, in particular with precipitators according to the invention, into a precipitation system to enable uninterrupted operation, in which the exhaust gas flow is applied independently to the individual precipitators, which may be operated in the different operating modes. The present invention thus likewise comprises such a precipitator system comprising at least one electrostatic precipitator according to the invention and at least one additional precipitator, which are fluid-mechanically coupled to one another in such a way that the exhaust gas flow may be independently applied to them, and they may be operated independently from one another in the precipitation mode or in the regeneration mode.

The precipitation system itself or each individual precipitator may have in itself a control and monitoring system which controls and monitors the operation of the respective precipitator and the precipitator system.

Thus, in the case of required continuous operation of the precipitator system, during maintenance or the regeneration mode of one or more precipitators, the exhaust gas flow may be diverted to at least one remaining precipitator operating in the precipitation mode, so that maintenance or regeneration of a precipitator may be safely carried out without stopping production.

The method according to the invention may thus also relate to the previously described operation of a precipitation system with a least two electrostatic precipitators.

DESCRIPTION OF THE DRAWINGS

Further goals, advantages, features and applications of the present invention are derived from the subsequent description of embodiments by way of the drawings. All described and/or depicted features per se or in any combination constitute the subject matter of the present invention, regardless of their summary in the claims or their back-reference. As shown in:

Identical or identically functioning components are provided with identical reference signs based on multiple embodiments in the subsequently depicted figures in order to improve readability.

DETAILED DESCRIPTION

Figure 1A:
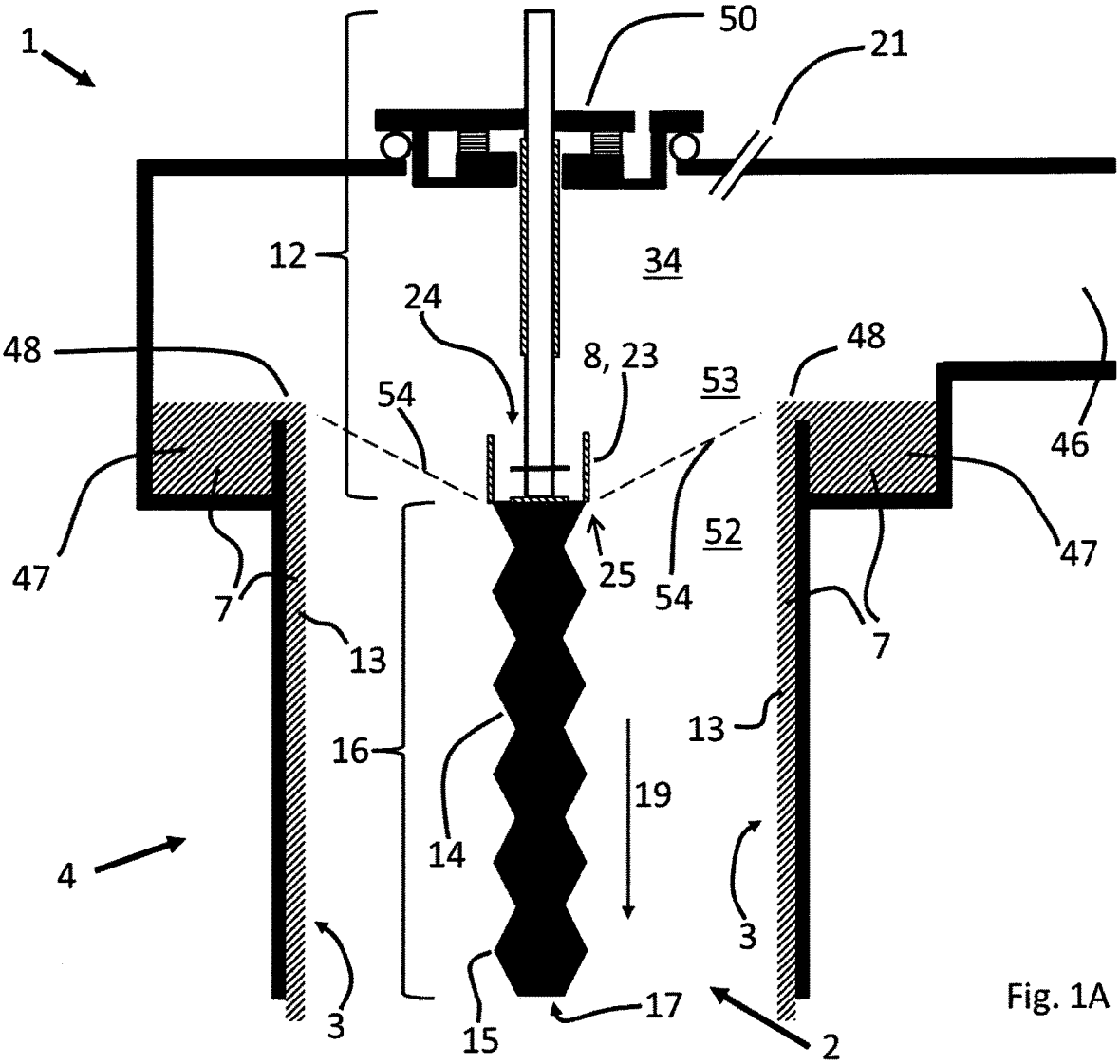
FIG. 1A a schematic depiction of a first embodiment of a tubular electrostatic precipitator for depicting the technical features, FIG. 1B a view identical with FIG. 1A in which the effects occurring during the precipitation mode are characterized, FIG. 2A an enlarged, schematic view of a part of the tubular precipitator according to FIG. 1A, FIG. 2B a view according to FIG. 2A, in which the effects occurring during the regeneration mode are characterized, FIG. 3A-3C schematic cross-sectional depictions of differently shaped spray electrodes, FIG. 4-6 schematic depictions of the bottom of flushing devices according to the invention with spray openings, FIG. 7 a schematic perspective depiction of an example for a flushing device, FIGS. 8 and 9 multiple schematic perspective views of flushing devices according to the invention with spray openings in the peripheral wall, FIG. 10A a schematic view of a second embodiment for depicting the technical features, FIG. 10B a depiction according to FIG. 10A, in which the effects occurring during the regeneration mode are characterized.

FIG. 1A shows a first embodiment of an electrostatic precipitator 1, which is designed as a tubular precipitator in the present example. A spray electrode 2 is applied suspended in the interior of precipitator 1. Spray electrode 2 is surrounded by a counter electrode 3 or lies opposite counter electrode 3, which is formed as a fluid wall 13 on the inner side of the precipitator column 4. Fluid wall 13 is to be understood as a liquid film which is formed by a separating liquid 7 running down the inner side in precipitator column 4.

To form fluid wall 13, separating liquid 7 emerges from an annular overflow channel 47 and flows downward on the inner side of precipitator column 4 influenced by gravity.

Spray electrode 2 is fixed with its head region 12 in an electrode collar 50 acting as a fluid barrier and is thus arranged suspended in precipitator column 4.

Multiple discharge points 15 are arranged on an active part 14 of spray electrode 2 which connects to head region 12 in longitudinal direction 19. Discharge points 15 are arranged uniformly along length 16 of spray electrode 2 in active part 14. Discharge points 15 project laterally from spray electrode 2 and are oriented in the direction of counter electrode 3.

A lower end region 17 of spray electrode 2 thereby hangs freely in precipitation chamber 34 formed by precipitator column 4.

Figure 1B:
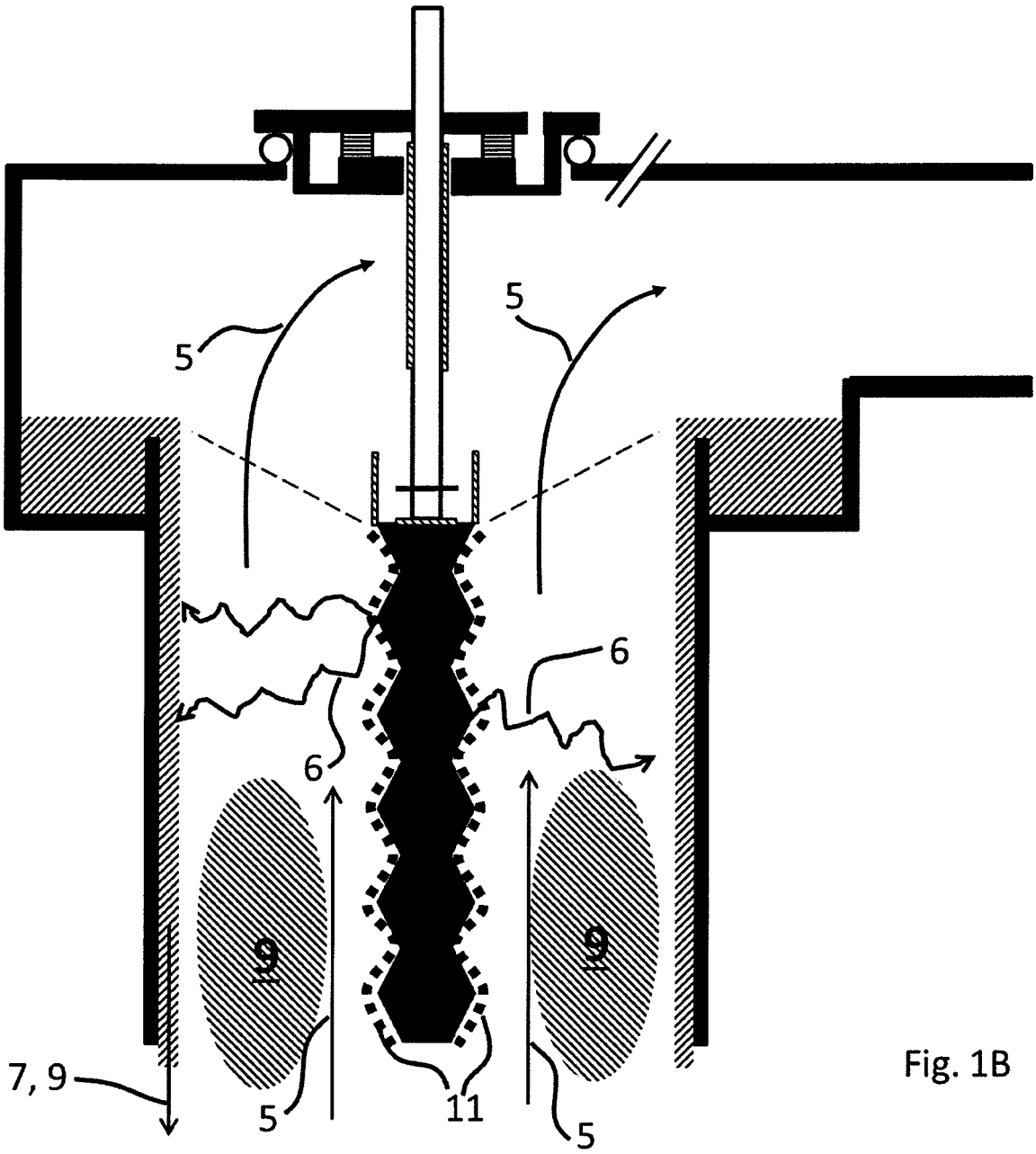

As is clear in FIG. 1B, during the precipitation mode of precipitator 1, an exhaust gas flow 5 enters into precipitation chamber 34 from the direction of lower end region 17. Exhaust gas flow 5 rises counter to the force of gravity from lower end region 17 in the direction of head region 12 of the spray electrode and leaves precipitation chamber 34 through an exhaust duct 46 in outflow region 53 of precipitator 1.

Outflow region 53 connects above active part 14 of spray electrode 2 to a precipitation region 52. The transition from precipitation region 52 into outflow region 53 is carried out approximately along connection line 54 between the transition from active part 14 of the spray electrode and an overflow 48 of overflow channel 47 of precipitator column 4. The flow directions of separating liquid 7 along precipitator column 4 and exhaust gas flow 5 are opposite.

Fluid wall 13, formed by separating liquid 7 discharging from overflow channel 47 in the direction of exhaust gas flow 5, extends along longitudinal direction 19 of spray electrode 2 up into its head region 12, thus above active part 14.

A flushing device 8, formed as a cup element 23, is arranged between head region 12 and active part 14 of spray electrode 2, the opening 24 of said cup element is directed toward head region 12. On its bottom 25, flushing device 8 has flushing openings 26 which function to generate a flushing stream 22.

Figure FIGS. 4-9 show examples of flushing device 8 with differently designed flushing openings 26.

A flushing liquid supply 21, which in the present case functions as a spray nozzle for generating an inflow 20 of flushing liquid 10, is arranged above active part 14 of spray electrode 2 in outflow region 53 of precipitator 1 close to the transition to exhaust duct 46.

As is depicted in FIG. 1B, exhaust gas flow 5 is guided upward into precipitation chamber 34 counter to the flow direction of separating liquid 7 during the precipitation mode. Exhaust gas flow 5 contains materials 9, depicted as dots, which are present in the present example as particles or as aerosols with particle sizes in the range of less than 10 μm.

Materials 9 carried along by exhaust gas flow 5 encounter a corona discharge 6 generated between spray electrode 2 and counter electrode 3 so that the materials to be separated are electrically charged with respect to the separating liquid in fluid wall 13 and are drawn into separating liquid 7 under the effect of electrostatic forces. In the present example, separating liquid 7 is situated on an electric ground potential. Upon impact of materials 9 on fluid wall 13, said materials 9 are captured by fluid wall 13 and are swept away to a drain, not depicted.

Purified exhaust gas flow 5 then enters into exhaust duct 46 in outflow region 53 and is there either emitted to the environment, subjected to a further exhaust gas treatment, or supplied to a downstream process.

During the precipitation mode of precipitator 1, deposits 11 are deposited over time, in particular on discharge points 15 of spray electrode 2. This hinders the generation of corona discharge 6. The precipitation output of precipitator 1 thus drops.

Figure 2A:
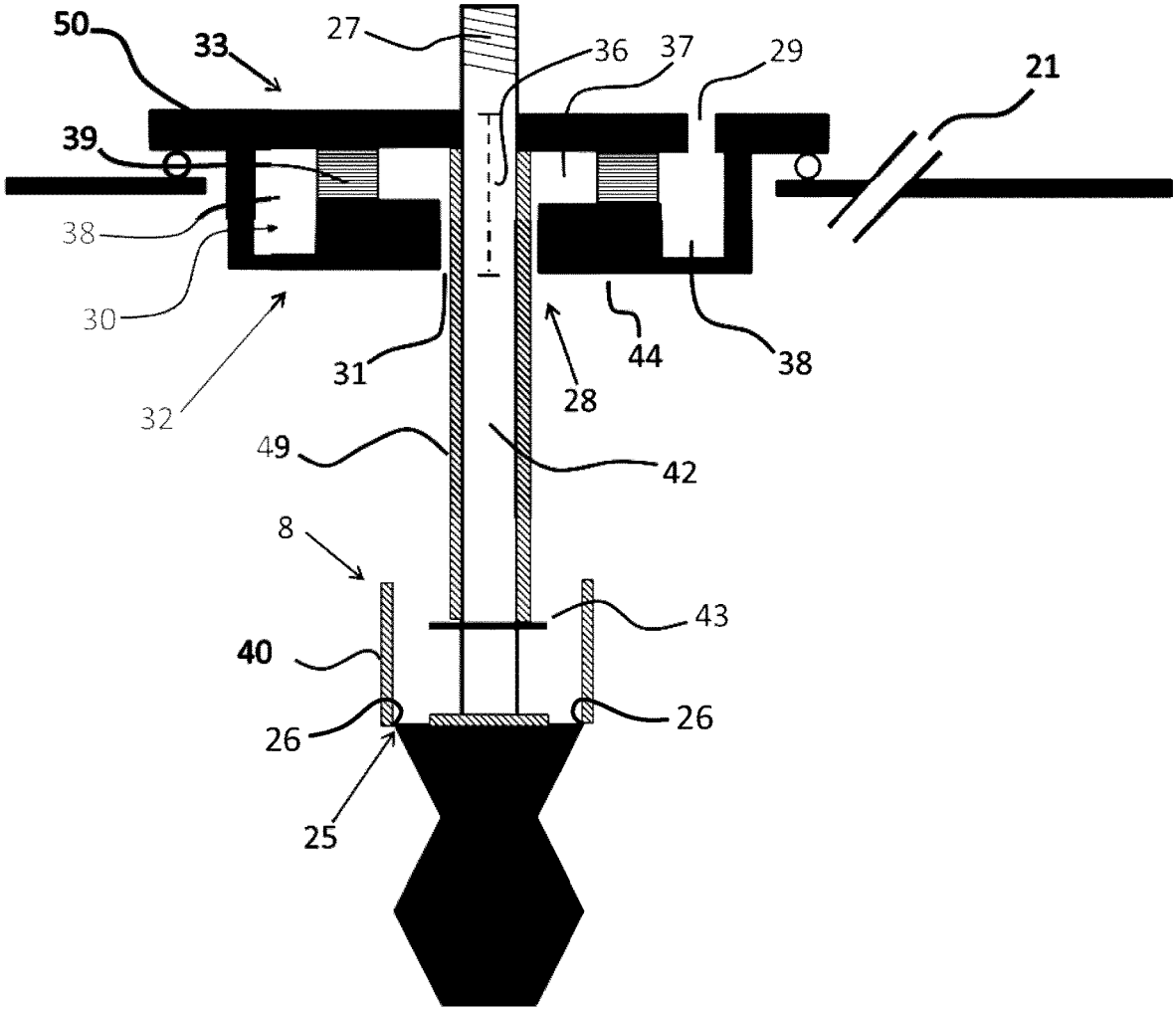

FIG. 2 shows an enlarged view of a part of precipitator 1 shown in FIG. 1A and FIG. 1B. Counter electrode 3 present as fluid wall 13 and also the upper wall of precipitation chamber 34 are present, yet not shown.

In addition to bottom 25, flushing device 8 also has a peripheral wall 40 belonging to cup element 23 which extends from bottom 25 in the direction of head region 12 into outflow region 53.

Spray electrode 2 in head region 12 is also provided with a rod element 42 designed as a retaining rod, which is provided in its exposed region with an insulating sheath 49 made from electrically insulating material. Insulating sheath 49 protrudes up into electrode collar 50 and opens out in a central chamber 37 of electrode collar 50.

Electrode collar 50 functions to separate an electrical connection 27 of spray electrode 2 from the moist atmosphere prevailing in precipitation chamber 34. Electrical connection 27 functions to connect spray electrode 2 to an electrical supply, not shown, by means of which a high voltage is applied to spray electrode 2. In the context of the present invention, high voltage is understood to be voltages, in particular direct voltages, in the range from 6 kilovolts to 25 kilovolts.

A purging gas 35, which is applied to central chamber 37, emerges into precipitation chamber 34 during the precipitation mode, or also continuously through a purging gap 31 formed between rod element 42 and a collar wall 44. Electrode collar 50 has a widening 28 in the region of collar wall 44 so that purging gap 31 between spray electrode 2 and collar wall 44 remains clear. Purging gap 31 and the magnitude of the application of purging gas 35 in central chamber 37 may thereby be designed in such a way that purging gas 35, located in central chamber 37, flows out through purging gap 31 into precipitation chamber 34 at 1.4 times the speed in comparison to the speed of exhaust gas flow 5 in precipitator column 4.

Purging gas 35 is preferably dry compressed air. Purging gas 35 surrounds a penetration segment 36 of spray electrode 2 enclosed in electrode collar 50 which is actively dried by purging gas 35 located in central chamber 37 and kept free from incoming liquid.

Central chamber 37 is separated from an outer annular chamber 38 by means of a homogenization device 39 in the form of an annular sponge element. Outer annular chamber 38 and central chamber 37 form a chamber 30, to which purging gas 35 is applied, which in turn is connected to a purging gas supply 29. To guarantee a uniform overflow of purging gas 25 from outer annular chamber 38 into central chamber 37, the homogenization device forms a flow resistance for purging gas 35 so that a pressure difference forms between outer annular chamber 38 and central chamber 37 to ensure a uniform pass through of purging gas through homogenization device 39 into central chamber 37. In this way it is guaranteed that practically no moisture may cross from a wet side 32 of electrode collar 50 to its dry side 33, by which means the presence of leakage currents may be practically prevented between electrical connection 27 and the interior of precipitator column 4. In addition, purging gap 31 at least largely prevents the formation of a continuous conductive film between spray electrode 2 and counter electrode 3 along the wet side 32 of electrode collar 50.

Figure 2B:
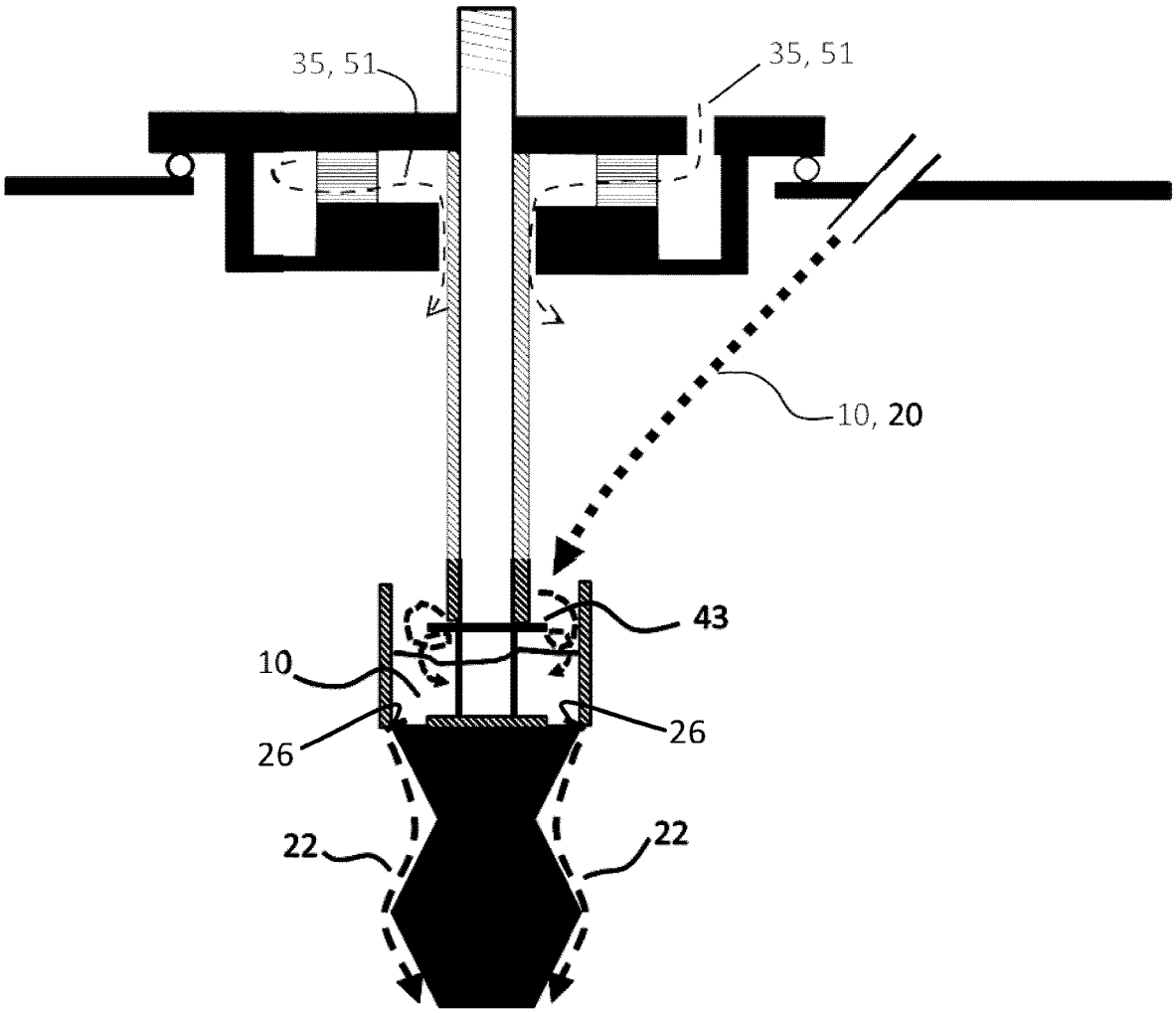

Flushing liquid supply 21, through which flushing liquid 10 may be guided into flushing device 8 as influx 20 in the form of a solid stream, is arranged to the side of electrode collar 50. This is depicted in FIG. 2B. It is thereby clear that influx 20 of flushing liquid 10 entering into flushing device 8 as a solid stream may be additionally swirled in the interior of flushing device 8 by means of a flow resistance 43 so that flushing liquid 10 is initially distributed uniformly within flushing device 8. Starting from flushing device 8, flushing liquid 10 then emerges as rinsing stream 22 via rinsing openings 26, depicted in FIGS. 4 through 9, onto active part 14 of the spray electrode in order to successively rinse discharge points 15 and to reduce deposits 11 present there.

At the same time, purging gas flow 51 of purging gas 35 is shown in FIG. 2B, which flows through purging gas supply 29 initially into outer annular chamber 38, further through homogenization device 39 into central chamber 37 and then through purging gap 31 into precipitation chamber 34.

Figure 3A:
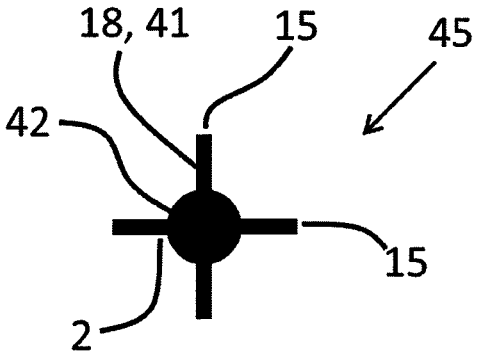
Figure 3B:
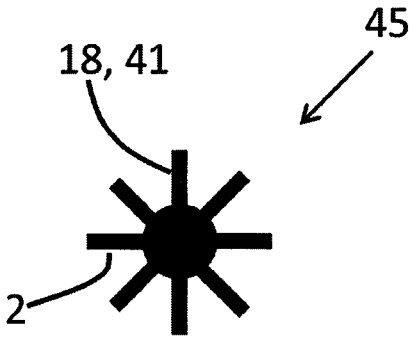
Figure 3C:
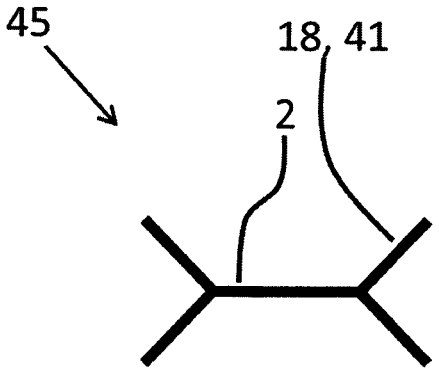

FIGS. 3A through 3C show three different possible cross-sectional shapes of spray electrode 2 in the region of its active part 14. The cross-sectional shape may thereby be designed as cross-shaped according to FIG. 3A, as star-shaped according to FIG. 3B, or as having multiple arms according to FIG. 3C. Rod element 42 may also extend, as is shown in FIG. 3A and FIG. 3B, up into active part 14. Spray electrode 2 may be designed as plate-like or rib-like, wherein multiple individual ribs or plates may be stamped at the edge to form discharge points 15 in order to then be joined into the respective cross-sectional shape. Discharge points 15 are formed at the edge on the respective plate elements 18 or rib elements 41. Cross sections 45, shown in FIGS. 3A through 3C, are merely examples and may also be shaped differently.

Flushing device 8 may be aligned preferably concentric to the respective cross section 45 of spray electrode 2 in its active part 14. Flushing device 8 in the form of a cup element 23 may be attached on rod element 42 and come to rest contacting active part 14.

Differently shaped and arranged rinsing openings 26, depicted in FIGS. 4 through 9, are preferably aligned with discharge points 15 of spray electrode 2 to rinse discharge points 15 in a most targeted way.

Figure 4:
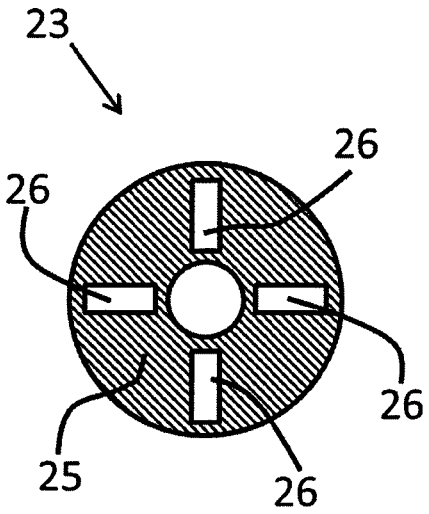
Figure 5:
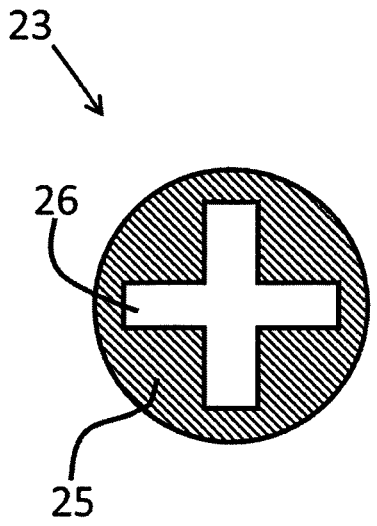
Figure 6:
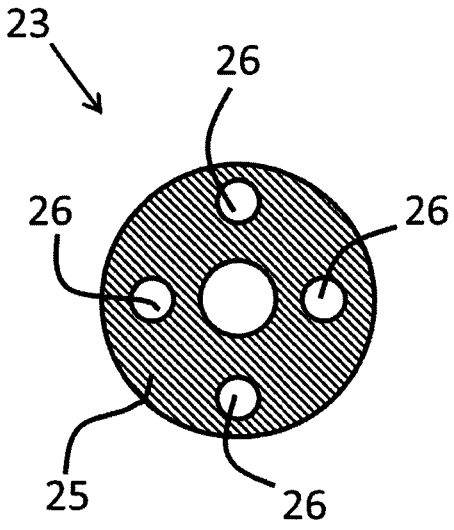
Figure 7:
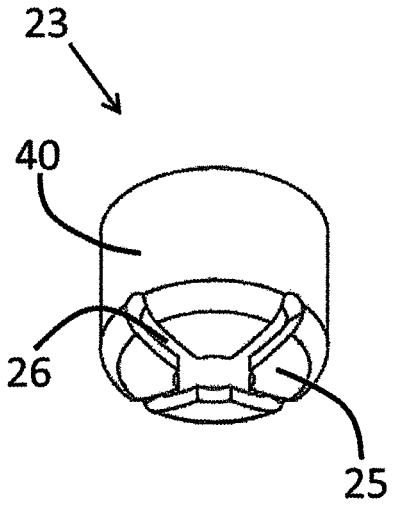
Figure 8:
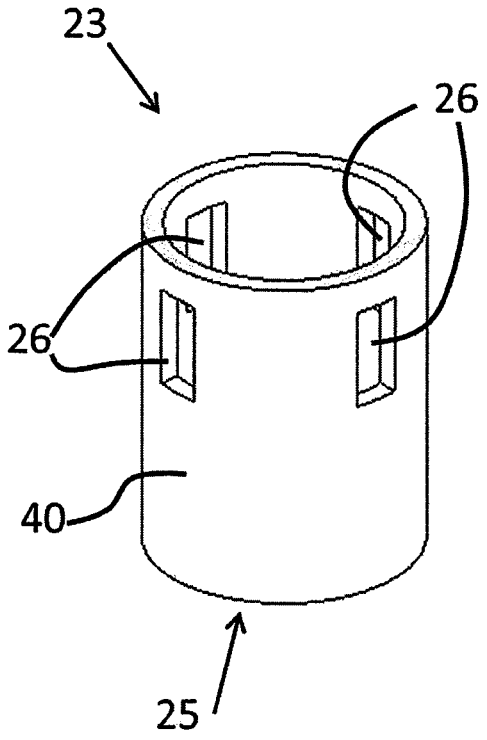
Figure 9:
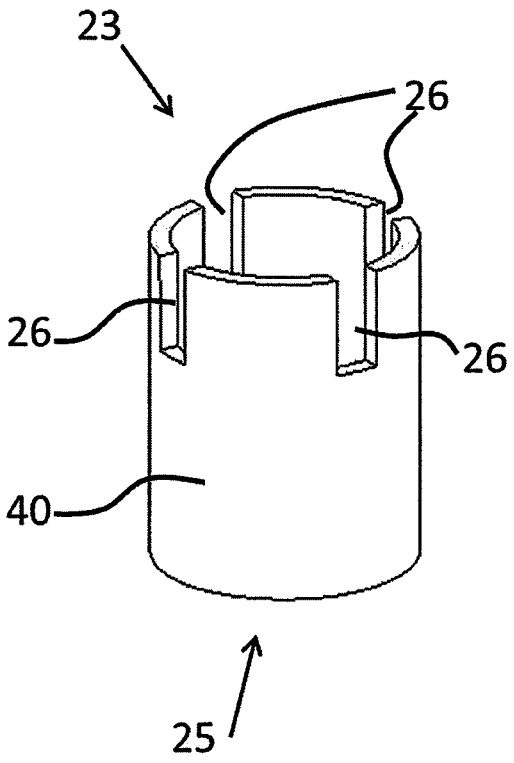

Rinsing openings 26 may, for example, be arranged cross shaped as slots, as are present in FIGS. 4 and 5, or also as holes. Alternatively, the rinsing openings may be provided as lateral slots or notches in a peripheral wall 40 of cup element 23, so that a rinsing flow 22 emerges via these rinsing openings 26 when flushing liquid 10 overflows in cup element 23. According to the depiction in FIG. 7, rinsing openings 26 may also be provided as cross-shaped slots, which at least partially protrude into lateral peripheral wall 40 starting from cup element bottom 25.

Figure 10A:
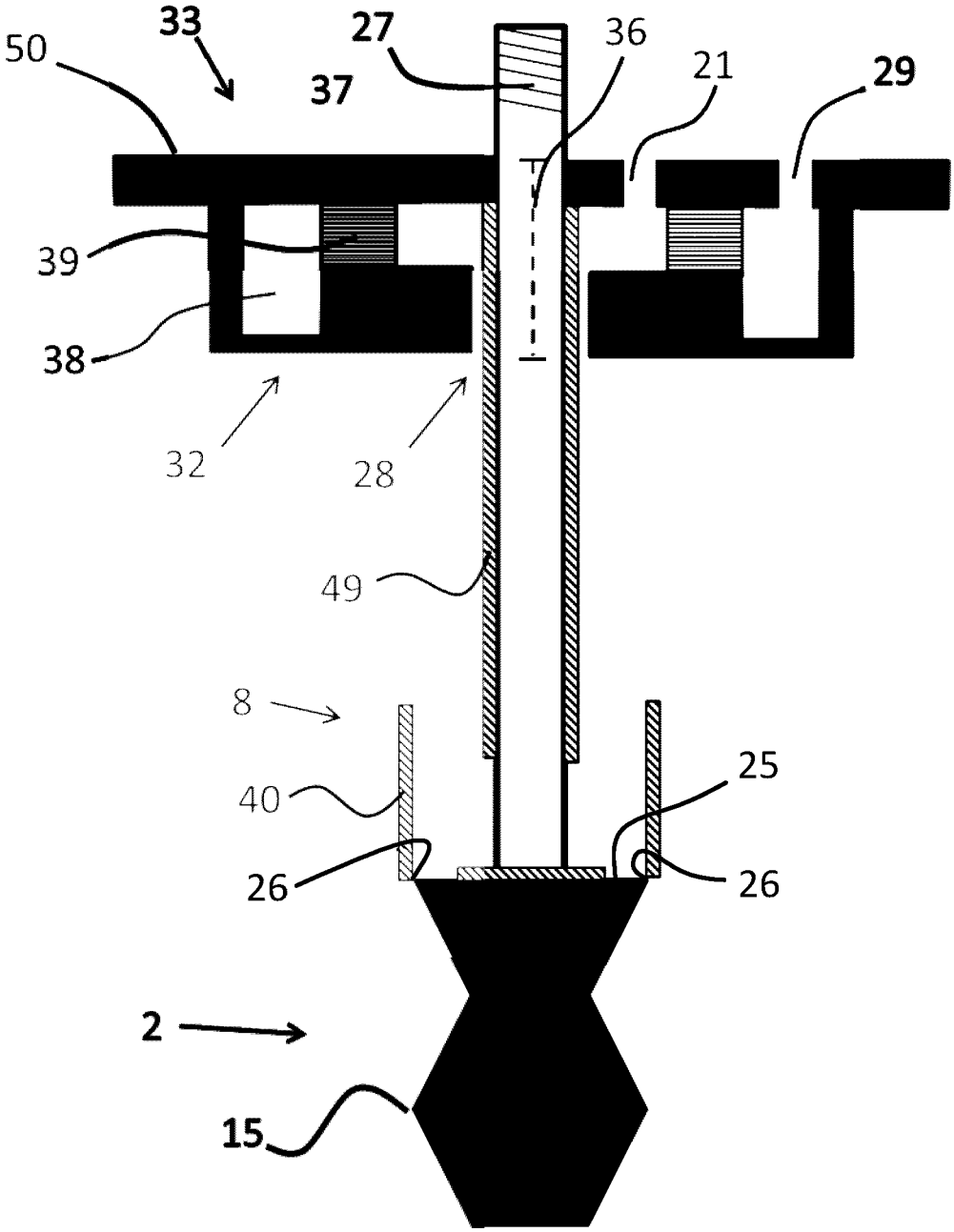
Figure 10B:
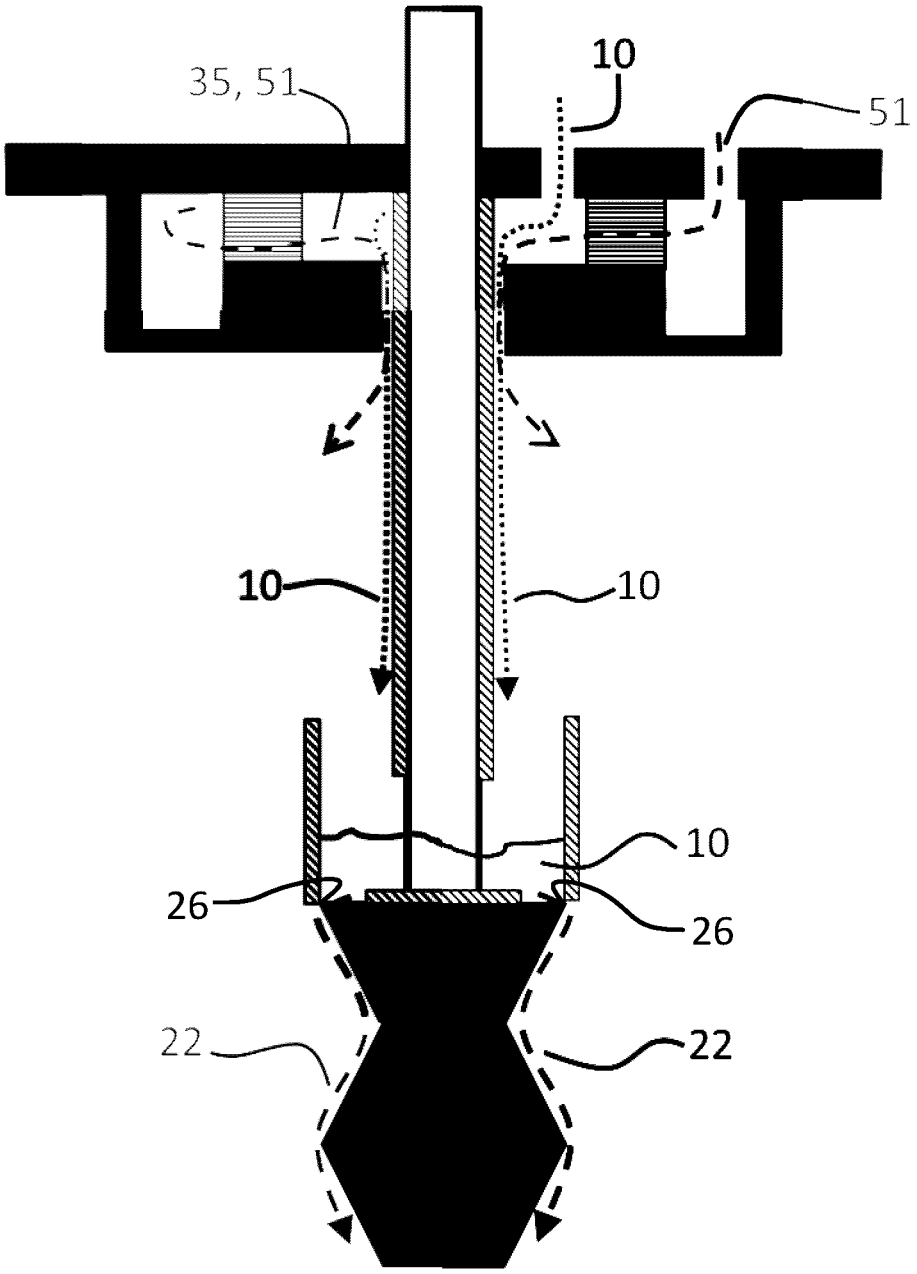

A second embodiment of the present invention is depicted in FIGS. 10A and 10B. In contrast to the first embodiment according to FIGS. 1A through 2B, this embodiment differs in that flushing liquid supply 21 is not designed as a separate nozzle next to electrode collar 50, but instead as an additional connection in electrode collar 50 via which flushing liquid may be guided into central chamber 37. While this does make the design of electrode collar 50 somewhat more complex, the provision of a flushing liquid supply 21 in precipitator column 4 may be omitted. As shown in FIG. 10B, an influx 20 no longer occurs as a solid stream and flushing liquid 10 may be guided more directly and in a targeted way through purging gap 31 along widening 28 into flushing device 8. After ending the supply of flushing liquid 10 into flushing liquid 8, purging gas flow 51 dries the region of penetration section 36 wetted by the flushing liquid so that the precipitation mode and the high voltage necessary for this may be switched on again at spray electrode 2. In any case, the complete draining of rinsing flow 22 out of flushing device 8 must be waited out, so that no chronological disadvantage is generated.

Overall, the present invention, according to the embodiments depicted here, allows a significantly more efficient and economical operation of the electrostatic precipitator, compared to the previously known functioning principles.

The precipitator shown here may be combined together with additional precipitators 1 into a precipitator system, which enables continuous operation through alternating and overlapping operation of individual precipitator columns 4.

REFERENCE NUMERALS

1 Electrostatic precipitator
2 Spray electrode
3 Counter electrode
4 Precipitator column
5 Exhaust gas flow
6 Corona discharge
7 Separating liquid
8 Flushing device
9 Material
10 Flushing liquid
11 Deposit
12 Head region
13 Fluid wall
14 Active part
15 Discharge point
16 Length
17 Lower end region
18 Plate element
19 Longitudinal direction
20 Influx
21 Flushing liquid supply
22 Flushing stream
23 Cup element
24 Opening
25 Bottom
26 Flushing opening
27 Electrical connection
28 Widening
29 Purging gas supply
30 Chamber
31 Purging gap
32 Wet side
33 Dry side
34 Precipitation chamber
35 Purging gas
36 Penetration segment
37 Central chamber
38 Annular chamber
39 Homogenization device
40 Peripheral wall
41 Rib element
42 Rod element
43 Flow resistance

44 Collar wall
45 Cross-section
46 Exhaust duct
47 Overflow channel
48 Overflow
49 Insulating sheath
50 Electrode collar
51 Purging gas flow
52 Precipitation region
53 Outflow region
54 Connection line

The invention claimed is:

1. An electrostatic precipitator for precipitating one or more materials out of an exhaust gas flow, comprising:

a spray electrode having an active part for generating a corona discharge and having a head region;

a flushing liquid supply to supply flushing liquid into the precipitator for removing deposits of the materials to be separated that settle on the spray electrode; and a flushing device configured to direct the flushing liquid across the head region of the spray electrode as a flushing stream onto the active part of the spray electrode, said flushing device having means for reducing the flow speed of the flushing stream with respect to the flow speed of an influx of flushing liquid delivered by the flushing liquid supply, and having a cup element having a bottom that faces the active part and having an opening that faces the head region of the spray electrode, wherein the bottom of the cup element and/or a peripheral wall of the cup element has at least one flushing opening for dispensing the flushing stream, and wherein at least one flow resistance is provided within the cup element to increase the flow resistance for the flushing liquid and/or to generate and/or reinforce a turbulent current in the flushing liquid.

2. The precipitator according to claim 1, wherein at least one projecting discharge point is provided in the active part of the spray electrode and the flushing device comprises devices for guiding the flushing stream over at least one discharge point.

3. The precipitator according to claim 2, wherein at least two discharge points are arranged in the longitudinal direction of the spray electrode, and the flushing device is configured so that the flushing stream successively flushes the at least two discharge points.

4. The precipitator according to claim 1, wherein the spray electrode is fixed at the head region in the precipitator, and the active part extending in a longitudinal direction is arranged suspended in the interior of the precipitator, and wherein the flushing stream runs off on the active part assisted by gravity.

5. The precipitator according to claim 1, wherein the spray electrode is configured in sections with at least one plate element or rib element and with at least one discharge point provided thereon.

6. The precipitator according to claim 5, wherein the flushing device is substantially concentric to the cross section of the spray electrode for a uniform distribution of the flushing liquid on the spray electrode.

7. The precipitator according to claim 1, wherein the at least one flushing opening for dispensing the flushing stream is a hole or a slot or a like opening.

8. The precipitator according to claim 1, wherein the at least one flushing opening is aligned at least one discharge point of the spray electrode.

9. The precipitator according to claim 1, wherein the least one flow resistance is a deflection device.

10. The precipitator according to claim 1, further comprising an electrical connection in the head region of the spray electrode for connecting the spray electrode to an electrical supply outside of a precipitation chamber of the precipitator, wherein the electrical connection and the precipitation chamber are separated from one another by an electrode collar.

11. The precipitator according to claim 10, wherein the electrode collar has a wet side and a dry side, and wherein the dry side is arranged outside of the precipitation chamber and the wet side is arranged inside of the precipitation chamber, and the electrode collar has a chamber, to which a purging gas is applied from outside, and through which a part of the spray electrode extends.

12. The precipitator according to claim 11, wherein the electrode collar has a widening, due to which a purging gap for the purging gas remains clear on the wet side between the spray electrode and the electrode collar.

13. The precipitator according to claim 12, wherein the chamber of the electrode collar for the spray electrode is divided into a central chamber and an outer annular chamber connected to a purging gas supply, and wherein the central chamber and the outer annular chamber are separated from one another by means of a homogenization device for a purging gas flow.

14. The precipitator according to claim 1 wherein the flushing liquid supply is configured so that the influx of flushing liquid enters at least partially as a solid stream into the flushing device.

15. The precipitator according to claim 11, wherein the flushing liquid supply is in a central chamber of the electrode collar.

16. A method for the electrostatic precipitation of materials out of an exhaust gas flow, comprising:

guiding exhaust gas flow through a corona discharge generated in a precipitator during a precipitation mode, said precipitator comprising:

a spray electrode having an active part for generating a corona discharge and having a head region;

a flushing liquid supply to supply flushing liquid into the precipitator for removing deposits of the materials to be separated that settle on the spray electrode; and a cup having a bottom that faces the active part and having an opening that faces the head region of the spray electrode, wherein the bottom of the cup and/or a peripheral wall of the cup has at least one flushing opening for dispensing the flushing stream, and wherein at least one flow resistance is provided within the cup to increase the flow resistance for the flushing liquid and/or to generate and/or reinforce a turbulent current in the flushing liquid wherein said corona discharge is generated between an active part of the at least one spray electrode and a counter electrode of the precipitator; and interrupting the exhaust gas flow and the corona discharge during a regeneration mode in order to remove deposits, made of the materials to be separated from the spray electrode by the flushing liquid and directing the flushing liquid from the cup across the head region of the spray electrode as a flushing stream onto the active part of the spray electrode so that the flushing stream runs along the spray electrode under the influence of gravity and thereby at least partially flushes away deposits, made of the materials, present on the spray electrode.

17. The method according to claim 16, wherein influx of flushing liquid is initially guided to the head region of the spray electrode and, by the cup, from there over the active part of the spray electrode as a flushing stream.

18. The method according to claim 16, further comprising swirling the flushing liquid during the generation of the flushing stream and/or distribution of the flushing liquid across a cross section of the spray electrode.

19. An electrostatic precipitator for precipitating one or more materials out of an exhaust gas flow, comprising:

a spray electrode having an active part for generating a corona discharge and having a head region;

a flushing liquid supply to supply flushing liquid into the precipitator for removing deposits of the material(s) to be separated that settle on the spray electrode; and a cup having a bottom that faces the active part and having an opening that faces the head region of the spray electrode, wherein the bottom of the cup and/or a peripheral wall of the cup has at least one flushing opening for dispensing a flushing stream, and wherein at least one flow resistance is provided within the cup to increase the flow resistance for the flushing liquid and/or to generate and/or reinforce a turbulent current in the flushing liquid.

* * * * *